US012102272B2

(12) United States Patent
Blythe

(10) Patent No.: US 12,102,272 B2
(45) Date of Patent: Oct. 1, 2024

(54) SOAP BAR GRATER APPARATUS AND SYSTEM

(71) Applicant: Jocelyn Blythe, Overton, NE (US)

(72) Inventor: Jocelyn Blythe, Overton, NE (US)

( * ) Notice: Subject to any disclaimer, the term of this patent is extended or adjusted under 35 U.S.C. 154(b) by 225 days.

(21) Appl. No.: 17/467,389

(22) Filed: Sep. 6, 2021

(65) Prior Publication Data

US 2022/0408981 A1 Dec. 29, 2022

Related U.S. Application Data

(60) Provisional application No. 63/058,194, filed on Jul. 29, 2020.

(51) Int. Cl.
*A47K 5/09* (2006.01)

(52) U.S. Cl.
CPC ..... *A47K 5/09* (2013.01)

(58) Field of Classification Search
CPC ..... A47K 5/09
See application file for complete search history.

(56) References Cited

FOREIGN PATENT DOCUMENTS

| | | | | |
|---|---|---|---|---|
| CN | 107184130 A | * | 9/2017 | ..... A47K 5/09 |
| FR | 2946241 A1 | * | 12/2010 | ..... A47K 5/09 |
| KR | 20160000551 U | * | 2/2016 | ..... A47K 5/09 |

OTHER PUBLICATIONS

Translation of CN-107184130 (Year: 2017).*
Translation of KR-20160000551 (Year: 2016).*
Translation of FR-2946241 (Year: 2010).*
Staempfli, "Soap Flakes" https://www.swiss-miss.com/2011/01/soap-flakes.html (Year: 2011).*
Mulvaney, "Trendy Houston restaurant gets Rice engineering students to develop soap dispenser" https://www.chron.com/news/houston-texas/houston/article/trendy-houston-restaurant-gets-rice-engineering-4406880.php (Year: 2013).*
In the Know, "Nifty dispenser makes it possible to use bar soap without touching it" https://www.youtube.com/watch?v=bGK9yMWDJME&t=1s (Year: 2018).*

* cited by examiner

*Primary Examiner* — Bobby Yeonjin Kim
(74) *Attorney, Agent, or Firm* — Malcolm Pipes

(57) ABSTRACT

A bar soap grater body comprises a bar soap chamber positioned over a soap flake dispensing chamber. A grater plate interposed between the bar soap chamber and the soap flake dispensing chamber comprises a handle at an one end and a stop at a second end with a grater surface between the first end and the second end. The grater plate is configured so a bar of soap placed into the bar soap chamber is positioned in contact against the grater surface. Wherein the handle when pushed in and out of the grater body moves the grater plate back and forth across the bottom surface of the bar of soap to shave flakes off the bar of soap that fall into the soap flake dispensing chamber.

22 Claims, 6 Drawing Sheets

SOAP BAR GRATER APPARATUS AND SYSTEM

CROSS REFERENCE TO RELATED APPLICATIONS

This application claims benefit of U.S. Provisional Application 63/058,194 filed Jul. 29, 2020, which is incorporated herein in entirety.

FIELD OF INVENTION

The present invention relates to the field of soap dispensers, and, more particularly to a soap bar grater for shaving flakes of soap from a soap bar

BACKGROUND

Many consumers use bar soap almost exclusively to wash their hands or body. However, liquid soap has made significant inroads in the market. Compared to bar soap, liquid soap works up into a lather more easily and can enable the area around a sink or tub/shower to be more easily cleaned. This is because bar soap gives rise to accumulation of unsightly soap scum on surfaces that is simply harder to clean.

A dispenser system for bar soap that minimizes the accumulation of soap scum and improve sanitation around a sink or in a tub/shower would be useful. A dispenser that provides a simple system to shave flakes off a bar of soap and isolates the bar soap from bathroom surfaces would improve sanitation and make cleaning the surfaces of bathrooms traditionally used to hold soap much easier. Further, any increase in the utility of bar soap can make inroads on liquid soap usage and thus reduce plastic waste from all of the bottles of liquid soap people currently buy. Even a small decrease in the use of liquid soap will reduce plastic waste, and for individuals, will substantially reduce their waste generation and thus carbon footprint substantially over several years.

Based on the foregoing, there is a need in the field of soap dispensers to isolate bar soap from contact with bathroom surfaces and allow for easily shaving flakes off a bar of soap and dispensing the flakes directly to a user.

SUMMARY

In an embodiment, a bar soap grating apparatus comprises a grater body having a bar soap chamber positioned over a soap flake dispensing chamber. A grater plate interposed between the bar soap chamber and the soap flake dispensing chamber comprising a handle at an one end extending outward from the grater body and a stop positioned at a second end with a grater surface between the first end and the second end, and configured so a bar of soap placed into the bar soap chamber is positioned in contact against the grater surface Wherein the handle when pushed in and out of the grater body moves the grater plate back and forth across the bottom surface of the bar of soap to shave flakes off the bar of soap that fall into the soap flake dispensing chamber.

The bar soap grating apparatus soap flake dispensing chamber comprises a chamber through a lower portion of the grater body sized to receive a human hand.

The bar soap grating apparatus further comprises at least one of a soap weight placed over the bar of soap to force the bar of soap down upon the grater plate; or a spring placed adjacent to the bar of soap to stabilize contact with the grater plate.

The grater body includes a base at a bottom the grater body.

The base comprises an adhesive to attach to a surface.

The grater surface comprises at least one angled blade.

The grater surface comprises a plurality of cutting edges integrated with an array of slots formed in the grater surface.

The grater surface comprises an array of teeth extending upward from an array of slots formed in the grater surface.

The grater comprises at least one angled blade, and can further comprises a plurality of cutting edges integrated with an array of slots formed in a surface of the grater, or the grater comprises an array of teeth extending upward from an array of slots formed in a surface of the grater.

In an embodiment, a grating device for generating soap flakes that comprises a grater body having a bar soap chamber positioned over a soap flake dispensing chamber and containing bar soap. A grater plate in contact with the bar soap and comprised of a grater surface with a bar of soap inserted into the bar soap chamber and vertically positioned so that a surface of the bar soap firmly contacts the grater surface. A grater plate in contact with the bar soap and comprised of a grater surface with a bar soap inserted into the bar soap chamber and vertically positioned so that a surface of the bar soap firmly contacts the grater surface. At least one stop integrated with the grater plate to moveably secure the grater plate inside the grater body. The grater plate when pushed in and out of the grater body moves the grater surface back and forth across the bar soap to shave flakes off the bar soap to fall into the soap flake dispensing chamber.

In an embodiment, a method for generating flakes from a bar soap that comprises positioning a bar soap in a bar soap chamber over a soap flake dispensing chamber comprising a grater body. Interposing a grater between the bar soap chamber and the soap flake dispensing chamber moveably retained inside the grater body by at least one attached stop. Extending the grater outward from the grater body using an integrated handle with the bar soap placed into the bar soap bar chamber to make contact against the grater. The grater when pushed in and out of the grater body using the handle moves a grater surface of the grater back and forth across a surface of the bar soap to shave flakes off the bar soap that fall into the soap flake dispensing chamber.

In an embodiment, a bar soap grating apparatus comprises a one-piece body having a bar soap bar chamber positioned over a soap flake dispensing chamber. A grater is interposed between the bar soap bar chamber and the soap flake dispensing chamber attached to a spring-loaded handle/lever, with the spring-loaded handle/lever extending outward from the one-piece body, and a bar of soap placed into the bar soap bar chamber is positioned so that a bottom surface of the bar of soap contacts the grater. The spring-loaded handle/lever when pushed in and out of the one-piece body moves the grater back and forth across the bottom surface of the bar of soap to shave flakes off the bar of soap that fall into the soap flake dispensing chamber.

In an embodiment, a grating device for generating soap flakes that comprises a one-piece body having a bar soap chamber positioned over a soap flake dispensing chamber and containing bar soap. A grater in contact with the bar soap and attached to a spring-loaded handle/lever, with the spring-loaded handle/lever extending outward from the one-piece body and bar soap placed into the bar soap chamber positioned so that a surface of the bar soap firmly contacts the grater. The spring-loaded handle/lever when pushed in and out of the one-piece body moves the grater back and forth over the bar soap to shave flakes off the bar soap that fall into the soap flake dispensing chamber.

In an embodiment, a method for generating flakes from a bar of soap, comprising the steps of positioning a soap bar in a bar soap bar chamber positioned over a soap flake dispensing chamber in a one-piece body; interposing a grater between the bar soap bar chamber and the soap flake dispensing chamber attached to a spring-loaded handle/lever; extending the spring-loaded handle/lever outward from the one-piece body with the soap bar placed into the bar soap bar chamber having a bottom surface in contact with the grater; wherein the spring-loaded handle/lever when pushed in and out of the one-piece body moves the grater back and forth across the bottom surface of the bar of soap to shave flakes off the soap bar that fall into the soap flake dispensing chamber.

Advantages

1. Improved sanitation of bathroom surfaces.
2. Isolation of bar soap from direct contact with bathroom surfaces.
3. Simple means for shaving flakes of soap from a soap bar.
4. Cheaper and easier to construct and use to shave flakes of soap from a bar of soap.
5. Reduction in plastic waste generation by reducing use of liquid soap plastic containers.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1:
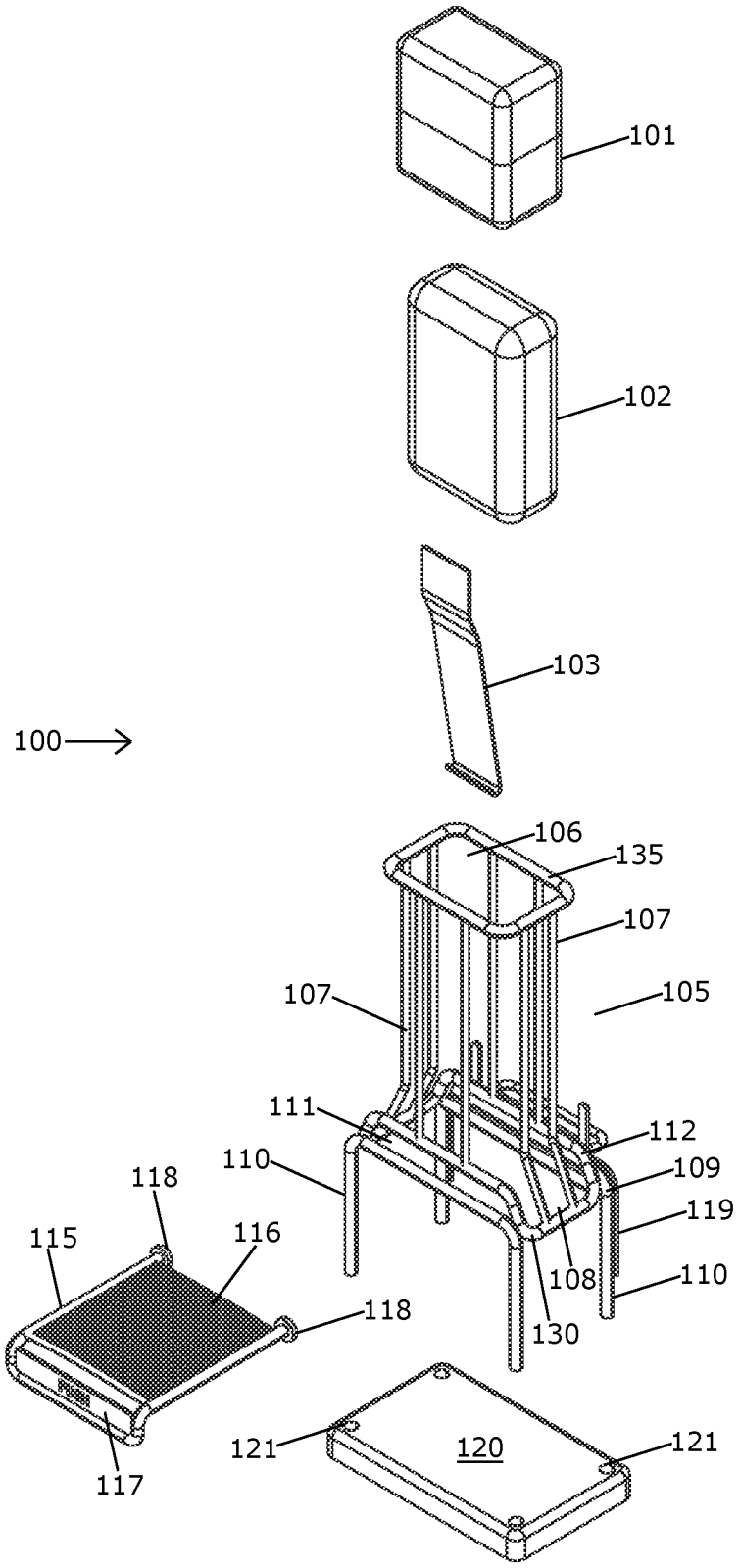
FIG. 1 is an exemplary exploded, disassembled view of the soap bar grater, according to an embodiment of the present invention.

Preferred embodiments of the present invention and their advantages may be understood by referring to FIGS. 1-6, wherein like reference numerals refer to like elements.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Headings provided herein are for convenience and are not to be taken as limiting the disclosure in any way.

The enumerated listing of items does not imply that any or all of the items are mutually exclusive, unless expressly specified otherwise.

The terms "a", "an" and "the" mean "one or more", unless expressly specified otherwise.

Devices or system modules that are in at least general communication with each other need not be in continuous communication with each other, unless expressly specified otherwise. In addition, devices or system modules that are in at least general communication with each other may communicate directly or indirectly through one or more intermediaries.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

The present invention will now be described in detail with reference to embodiments thereof as illustrated in the accompanying drawings.

FIG. 1 shows an exemplary embodiment of an exploded, disassembled view of the soap bar grater 100 showing the major components. In the disassembled front view as depicted, a soap bar storage and grater body 105 can be formed as a multi-component metal wire structure with the component pieces fastened or welded/soldered, or otherwise joined together. The metal wire is of sufficient thickness gauge to provide weight to keep the soap bar grater 100 anchored by its weight and provide durability to resist bending. An exemplary gauge range of wire is approximately ⅛ inch to 3⁄16 inch in diameter. Alternatively, the grater body 105 (and other components) can be constructed from polymers, ceramics, composites, acrylics, artificial stone, porcelain, or sold metal. The grater body 105 can include a roughly rectangular top rim 135 forming a receiving portal 106 for inserting a bar of soap 102 into the grater body 105. The receiving portal 106 in a preferred embodiment can be a rectangle a bit larger than bar of soap 102 to facilitate inserting the bar of soap 102 into the grater body 105.

As depicted, multiple body rods 107 can be attached to and extend downward vertically from the top rim 135 and receiving portal 106 and can extend downward to attach around a bottom rim 130 that can form a bottom portal 108. The open internal area formed by the body rods 107 can be referred to as a bar soap chamber.

As depicted, a front and rear arch 109 can attach to the bottom rim 130 to form support legs 110. Additionally, the bottom rim 130 can be bent and offset so that the attached front and rear arches 109 form a front slot 111 and rear slot 112 for receiving a moveable grater plate 115 that can move back and forth within the slots 111 and 112. Support legs 110 can be inserted into leg support holes 121 on a base 120.

The moveable grater plate 115 can be formed by a roughly U-shaped metal rod with a grater surface 116 attached between parallel legs of the U. The end of the parallel legs can include a pair of slide stops 118 used to secure the grater plate 115 within the grater body 105. A stop plate 119 can attach to the rear arch 109 to engage slide stops 118 when assembled to prevent grater plate 115 from being removed during use. The front end of the grater plate 115 can include a bent handle 117 that also functions as a stop. When assembled, the grater plate 115 can slide back and forth within slots 111 and 112. The grater surface 116 can be formed by using one or more angled blades associated with a slot, a plurality of cutting edges integrated with an array of slots, and/or an array of teeth extending upward from an array of slots. The grater surface 116 can also comprise at least one angled blade, and can further comprise a plurality of cutting edges integrated with an array of slots formed in the grater surface 116, and/or the grater surface 116 can comprises an array of teeth extending upward from an array of slot.

As depicted, grater body 105 can include a stabilizing tension spring 103 attached to the inside of the grater body 105 that pushes against bar of soap 102 to secure the bar of soap 102 in place laterally and vertically within the grater body 105. A soap weight 101 can be inserted into the receiving portal 106 on top of the bar of soap 102 to maintain vertical pressure against the grater plate 115.

As depicted, base 120 can be placed on a bathroom sink or edge of a bath tub or shower. The body 105 can also feature a soap flake dispensing chamber (not depicted) formed by support legs 110 that can receive a user's hand and dispenses soap flakes from the bar of soap 102 produced from the grater plate 115 when moved back and forth in slots 111 and 112. The base 120 can further include an adhesive on the bottom to anchor to the surface.

Figure 2:
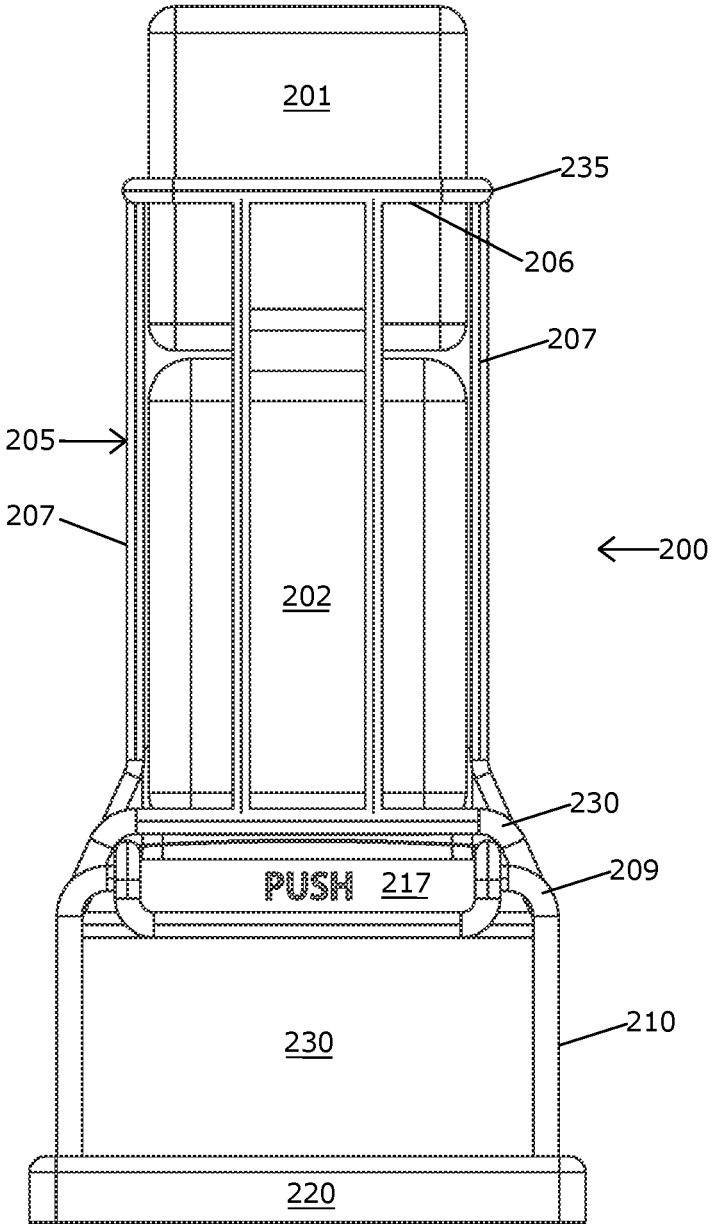
FIG. 2 is an exemplary front view of the assembled soap bar grater, according to an embodiment of the present invention.

FIG. 2 shows an embodiment of a front view of the assembled soap bar grater 200. The front view depicts a grater body 205, which can feature a base 220 and a soap flake dispensing chamber 250 sized to receive a user's hand. Grater body 205 can be formed as a multi-component metal wire structure with the component pieces fastened or welded/soldered, or otherwise joined together. The metal wire is of sufficient thickness gauge to provide weight to keep the soap bar grater 200 anchored by its weight and provide durability to resist bending. An exemplary gauge range of wire is approximately ⅛ inch to 3⁄16 inch in diameter. Alternatively, the grater body 205 (and other components) can be constructed from polymers, ceramics, composites, acrylics, artificial stone, porcelain, or sold metal.

As depicted, the grater body 205 can include a roughly rectangular top rim 235 forming a receiving portal 206 for inserting a bar of soap 202 into the grater body 205. The receiving portal 206 in a preferred embodiment can roughly be a rectangle a bit larger than bar of soap 202 to facilitate inserting the bar of soap 202 into the grater body 205.

As depicted, multiple body rods 207 can be attached to and extend downward vertically from the top rim 235 and receiving portal 206 and can extend downward to attach around a bottom rim 230 that can form a bottom portal 108. A front arch 209 can attach to the bottom rim 230 to form support legs 210. Additionally, the bottom rim 230 can be bent and offset so that the attached front arch 209 forms a front slot 111 receiving moveable grater plate 115 that can move back and forth within the slot 111 using handle 217. Support legs 210 can be attached to a base 120. A soap weight 201 can be inserted into the receiving portal 206 on top of the bar of soap 202 to maintain vertical pressure against the grater plate 115.

As depicted, base 220 can be placed on a bathroom sink or edge of a bath tub or shower. The soap flake dispensing chamber 250 formed by support legs 210 can receive a user's hand and dispenses soap flakes from the bar of soap 202 produced from the grater plate 115 when moved back and forth in slot 211. The base 220 can further include an adhesive on the bottom to anchor to the surface.

Figure 3:
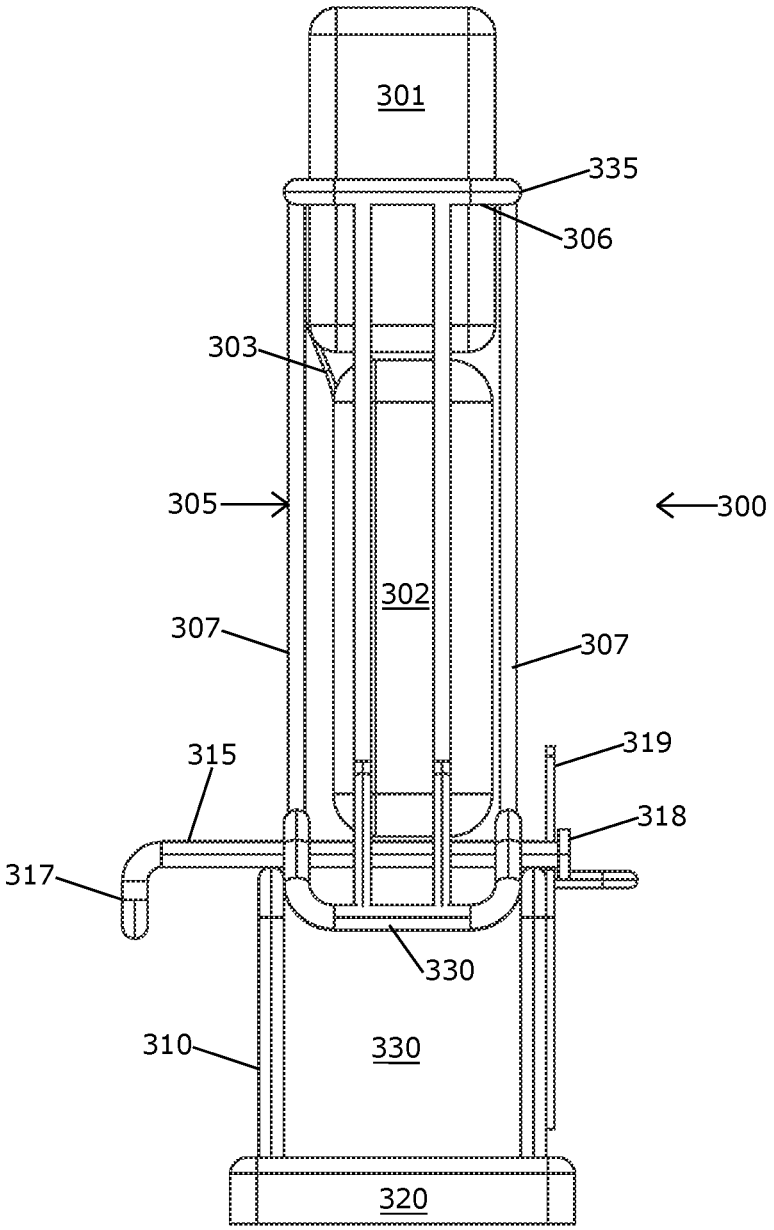
FIG. 3 is an exemplary side view of the soap bar grater, according to an embodiment of the present invention.

FIG. 3 shows an embodiment of a side view 300 of the soap bar grater. The side view 300 depicts grater body 305 that can be formed as a multi-component metal wire structure with the component pieces fastened or welded/soldered, or otherwise joined together. The metal wire is of sufficient thickness gauge to provide weight to keep the soap bar grater 300 anchored by its weight and provide durability to resist bending. An exemplary gauge range of wire is approximately ⅛ inch to 3/16 inch in diameter. Alternatively, the grater body 305 (and other components) can be constructed from polymers, ceramics, composites, acrylics, artificial stone, porcelain, or sold metal. The grater body 305 can include a roughly rectangular top rim 335 forming a receiving portal 306 for inserting a bar of soap 302 into the grater body 305. The receiving portal 306 in a preferred embodiment can be a rectangular shape a bit larger than bar of soap 302 to facilitate inserting the bar of soap 302 into the grater body 305. Grater body 305 can also include a stabilizing tension spring 303 attached to the inside of the grater body 305 that pushes against bar of soap 302 to secure the bar of soap 302 in place laterally and vertically within the grater body 305.

As depicted, multiple body rods 307 can be attached to and extend downward vertically from the top rim 335 and receiving portal 306 to attach around a bottom rim 330 that can form a bottom portal 308.

As depicted, a moveable grater plate 315 can be positioned adjacent to and in contact with bar of soap 302. The rear end of the grater plate 315 can include a pair of slide stops 318 used to secure the grater plate 315 within the grater body 305 using stop plate 319. The front end of the grater plate 315 can include a bent handle 317 that also functions as a stop. When assembled, the grater plate 315 can slide back and forth across bar of soap 302 to shave flakes of soap of the bar of soap 302. Stop plate 319 engaged with stops 318 together with handle 317 can retain grate plate 315 within grater body 305 during use.

As depicted, grater body 305 can also include a stabilizing tension spring 303 attached to the inside of the grater body 305 that pushes against bar of soap 302 to stabilize the bar of soap 302 in place laterally and vertically within the grater body 305. A soap weight 301 can be inserted into the receiving portal 306 on top of the bar of soap 302 to maintain vertical pressure against the grater plate 315.

As depicted, base 320 can be placed on a bathroom sink or edge of a bath tub or shower. The body 305 can also feature a soap flake dispensing chamber 350 formed by support legs 310 that can receive a user's hand and dispenses soap flakes from the soap bar of soap 302 produced from the grater plate 315 when moved back and forth within grater body 305. The base 320 can further include an adhesive on the bottom to anchor to the surface.

Figure 4:
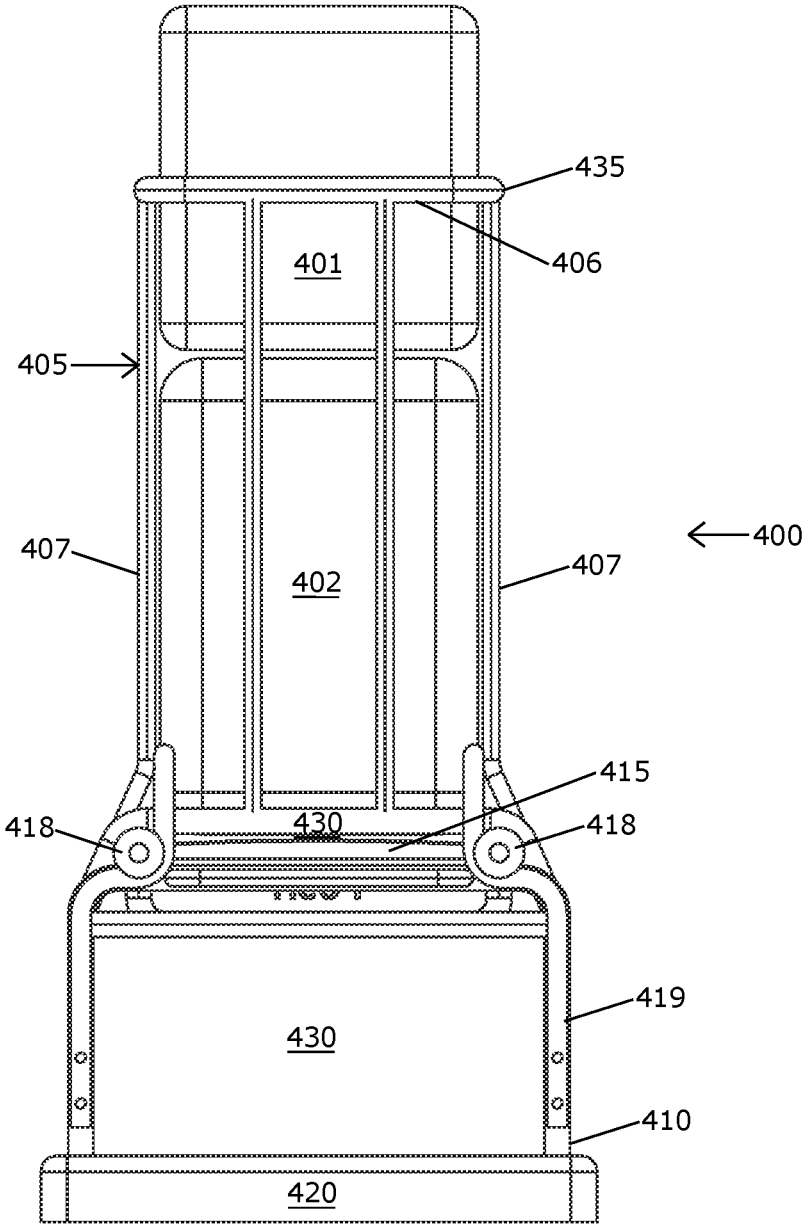
FIG. 4 is an exemplary back view of the soap bar grater, according to an embodiment of the present invention.

FIG. 4 shows an embodiment of a back view 400 of the soap bar grater. The back view 400 depicts a grater body 405, which can feature a base 420 and a soap flake dispensing chamber 435 that soap flakes fall into from bar of soap 403. The grater body 405 can include a roughly rectangular top rim 435 forming a receiving portal 406 for inserting a bar of soap 402 into the grater body 405. The receiving portal 406 in a preferred embodiment can be a rectangular shape a bit larger than bar of soap 402 to facilitate inserting the bar of soap 402 into the grater body 405. Multiple body rods 407 can be attached to and extend downward vertically from the top rim 435 and receiving portal 406 to attach around a bottom rim 430.

As depicted, a moveable grater plate 415 can be positioned adjacent to and in contact with bar of soap 402. The rear end of the grater plate 415 can include a pair of slide stops 418 used to secure the grater plate 415 within the grater body 405 using stop plate 419. When assembled, the grater plate 415 can slide back and forth across bar of soap 402 to shave flakes of soap of the bar of soap 402. Stop plate 419 and stops 418 together with handle 417 can retain grate plate 415 within grater body 405 during use. A soap weight 401 can be inserted into the receiving portal 406 on top of the bar of soap 402 to maintain vertical pressure against the grater plate 415.

As depicted, base 420 can be placed on a bathroom sink or edge of a bath tub or shower. The body 405 can also feature a soap flake dispensing chamber 450 formed by support legs 410 that can receive a user's hand and dispenses soap flakes from the bar of soap 402 produced from the grater plate 415 when moved back and forth within grater body 405. The base 420 can further include an adhesive on the bottom to anchor to the surface.

Figure 5:
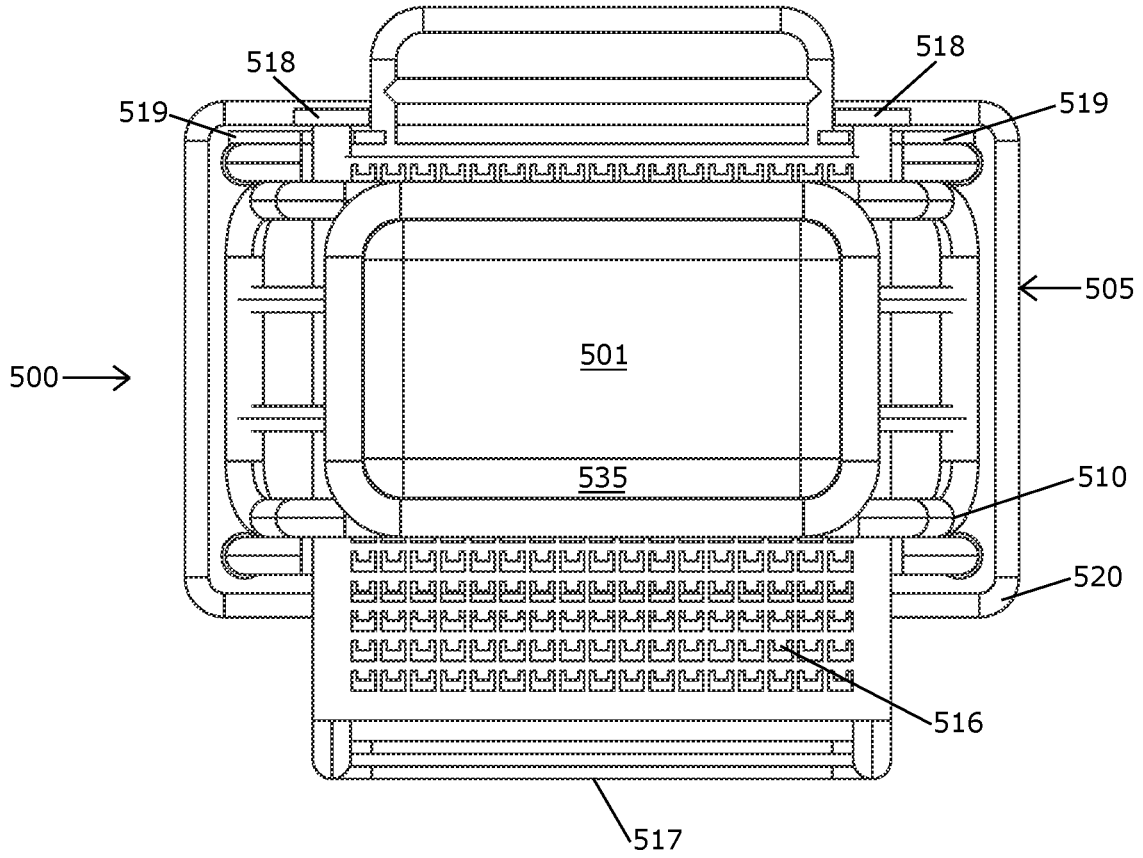
FIG. 5 is an exemplary top view of the soap bar grater, according to an embodiment of the present invention.

FIG. 5 shows an exemplary top view 500 of the soap bar grater. The top view depicts a grater body 505, which can feature a soap weight 501 inserted within top rim 535. Bottom rim 530 forms a slot, so that grater plate 517 can inserted into grater body 505. The opposite end of grater plate 517 can include stops 518 engaged by stop plates 519 that retain grater plate 517 within grater body 505. Base 520 can be placed on a bathroom or kitchen surface for use.

Figure 6:
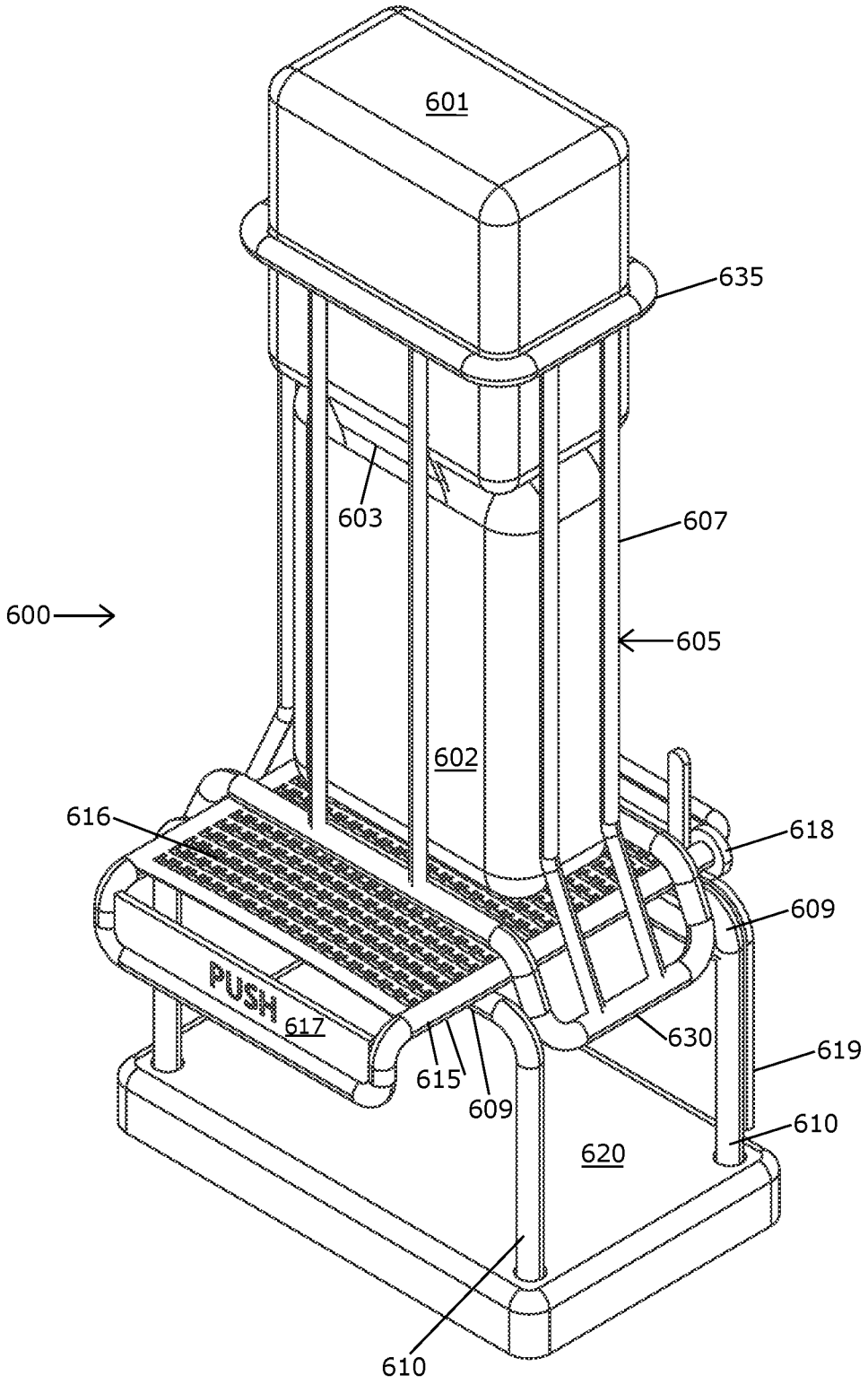
FIG. 6 is an exemplary perspective front view of the soap bar grater, according to an embodiment of the present invention.

FIG. 6 shows an exemplary perspective front view 600 of the soap grater. A soap bar storage and grater body 605 can be formed as a multi-component metal wire structure with the component pieces fastened or welded/soldered, or otherwise joined together. Grater body 605 can include a roughly rectangular top rim 635 forming a receiving portal 106 for inserting a bar of soap 602 into the grater body 605. The receiving portal 106 in a preferred embodiment can be a rectangle a bit larger than bar of soap 602 to facilitate inserting the bar of soap 602 into the grater body 605.

As depicted, multiple body rods 607 can be attached to and extend downward vertically from the top rim 635 to attach around a bottom rim 630 that can form a bottom portal 108. A front and rear arch 609 can attach to a bottom rim 630 to form support legs 610. Additionally, the bottom rim 630 can be bent and offset so that the attached front and rear arches 609 form a front slot 111 and rear slot 112 for receiving a moveable grater plate 615 that can move back and forth within the slots 111 and 112.

As depicted, the moveable grater plate 615 can be formed by a roughly squared-off U-shaped metal rod with a grater surface 616 attached between parallel legs of the U. The end of the parallel legs can include a pair of slide stops 618 used to secure the grater plate 615 within the grater body 105. A stop plate 619 can attach to the rear arch 609 to engage slide stops 618 when assembled to prevent grater plate 615 from being removed during use. The front end of the grater plate 615 can include a bent handle 617 that also functions as a stop. Grater plate 615 can slide back and forth within slots 111 and 112 when in use.

As depicted, grater body 605 can include a stabilizing tension spring 603 attached to the inside of the grater body 605 that pushes against bar of soap 602 to stabilize the bar of soap 602 in place laterally and vertically within the grater body 605. A soap weight 601 can be inserted into the receiving portal 606 on top of the bar of soap 602 to maintain vertical pressure against the grater plate 615.

As depicted, base 620 can be placed on a surface such as a bathroom sink or edge of a bath tub or shower. The body 605 can also feature a soap flake dispensing chamber (not depicted) formed by support legs 610 that can receive a user's hand and dispenses soap flakes from the bar of bar 602 produced from the grater plate 615 when moved back and forth in slots 111 and 112 against bar of soap 602. The base 620 can further include an adhesive on the bottom to anchor to the surface.

In alternative embodiments, the grater can be located on top of a soap bar with a weight or spring-loaded mechanism maintaining contact between the top surface of the soap bar and the bottom surface of the grater. Further, the grated flakes may be allowed to accumulate with one lever used to grate the soap and a separate lever to push soap flakes out into your hand in the dispensing chamber.

Insofar as the description above and the accompanying drawing disclose any additional subject matter that is not within the scope of the single claim below, the inventions are not dedicated to the public and the right to the one or more applications to claim such additional inventions is reserved.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The foregoing has described methods and systems for a patient movement monitoring and feedback system that are given for illustration and not for limitation and uses. Thus, the inventions are limited only by the appended claims. Although the inventions have been described in accordance with the embodiments shown, one of ordinary skill in the art will readily recognize that there could be variations to the embodiments and those variations would be within the spirit and scope of the present inventions. Accordingly, many modifications may be made by one of ordinary skill in the art without departing from the spirit and scope of the appended claims.

Particular terminology used when describing certain features or aspects of the embodiments should not be taken to imply that the terminology is being redefined herein to be restricted to any specific characteristics, features, or aspects with which that terminology is associated. In general, the terms used in the following claims should not be construed to be limited to the specific embodiments disclosed in the specification, unless the above Detailed Description section explicitly defines such terms. Accordingly, the actual scope of the claims encompasses not only the disclosed embodiments, but also all equivalent ways of practicing or implementing the claimed subject matter.

The above detailed description of the embodiments is not intended to be exhaustive or to limit the disclosure to the precise embodiment or form disclosed herein or to the particular fields of usage mentioned above. While specific embodiments and examples are described above for illustrative purposes, various equivalent modifications are possible within the scope of the disclosure, as those skilled in the relevant art will recognize. Also, the teachings of the embodiments provided herein can be applied to other systems, not necessarily the system described above. The elements and acts of the various embodiments described above can be combined to provide further embodiments.

Any patents, applications and other references that may be listed in accompanying or subsequent filing papers, are incorporated herein by reference. Aspects of embodiments can be modified, if necessary, to employ the systems, functions, and concepts of the various references to provide yet further embodiments.

In light of the above "Detailed Description," the Inventors may make changes to the disclosure. While the detailed description outlines possible embodiments and discloses the best mode contemplated, no matter how detailed the above appears in text, embodiments may be practiced in a myriad of ways. Thus, implementation details may vary considerably while still being encompassed by the spirit of the embodiments as disclosed by the inventors. As discussed herein, specific terminology used when describing certain features or aspects should not be taken to imply that the terminology is being redefined herein to be restricted to any specific characteristics, features, or aspects of the embodiments with which that terminology is associated.

While certain aspects are presented below in certain claim forms, the inventors contemplate the various aspects in any number of claim forms. Accordingly, the inventors reserve the right to add additional claims after filing the application to pursue such additional claim forms for other aspects.

The above specification, examples and data provide a description of the structure and use of exemplary implementations of the described systems, articles of manufacture and methods. It is important to note that many implementations can be made without departing from the spirit and scope of the disclosure.

MODIFICATIONS AND VARIATIONS

As will be recognized by those skilled in the art, the innovative concepts described in the present application can be modified and varied over a tremendous range of applications, and accordingly the scope of patented subject matter is not limited by any of the specific exemplary teachings given. It is intended to embrace all such alternatives, modifications and variations that fall within the spirit and broad scope of the appended claims.

The grater body can vacuum molded plastic or printed on a 3D printer. It can also be formed from a single piece of acrylic, machined natural, or formed synthetic or artificial stone. Various types of decorative concrete may be used to form the body or even a ceramic. The body can even include decorative designs or made in various colors, including multi-color designs.

While the grater handle/lever as depicted is made from plastic, other materials are possible such as metal, wood, bamboo, or artificial wood/composites. Similar construction can be used for all components.

Rather than a weight pressing down on bar soap to maintain contact with a grater plate or surface, a spring loaded plate can be used to assert pressure on a soap bar to maintain contact with a grater. Other mechanisms may also be utilized.

The grater can be replaced or supplemented by one or more angled blades that shave flakes from the bar soap when moved across the bar soap surface.

In yet another alternative embodiment, the general structure can be utilized but the upper portion modified so that the grater plate remains stationary while the upper body is moved back and forth across a grater surface.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

The claims as filed are intended to be as comprehensive as possible, and NO subject matter is intentionally relinquished, dedicated, or abandoned.

I claim:

1. A bar soap grating apparatus, comprising:

a grater body having a bar soap chamber positioned over a soap flake dispensing chamber, said bar soap chamber comprising four vertical sides with at least one vertical side including an attached stabilizing tension flat spring adjacent to and in contact with a bar of soap placed into the bar soap chamber;

a grater plate interposed between the bar soap chamber and the soap flake dispensing chamber comprising a handle at an one end extending outward from the grater body and a stop positioned at a second end with a grater surface between the first end and the second end, and configured so the bar of soap placed into the bar soap chamber is positioned in contact against the grater surface;

said the handle further comprising an elongated length of thin metal rod bent into a roughly U-shaped configuration integrated with the top of the flake dispensing chamber to form two parallel sides attached to a flat grater surface to form the grater plate, with the two parallel sides of the elongated length of thin metal rod terminating in two attached disks engaging a rear side of the soap flake dispensing chamber forming the stop and sliding back and forth against the stops, with the U of the configuration forming a grip for the handle; and wherein the handle when pushed in and out of the grater body moves the grater plate back and forth across the bottom surface of the bar of soap to shave flakes off the bar of soap that fall into the soap flake dispensing chamber.

2. The bar soap grating apparatus of claim 1, further comprising at least one of— a soap weight placed over the bar of soap to force the bar of soap down upon the grater plate; or said stabilizing tension flat spring placed adjacent to the bar of soap to stabilize both lateral and vertical contact with the grater plate.

3. The bar soap grating apparatus of claim 1, wherein the soap flake dispensing chamber comprises a chamber through a lower portion of the grater body sized to receive a human hand.

4. The bar soap grating apparatus of claim 1, wherein the grater body includes a base at a bottom the grater body.

5. The bar soap grating apparatus of claim 4, wherein the base comprises an adhesive to attach to a surface.

6. The bar soap grating apparatus of claim 1, wherein the grater surface comprises multiple angled blades configured as an array of teeth and slots in the grater surface.

7. The bar soap grating apparatus of claim 1, wherein the grater surface comprises a plurality of cutting edges integrated with an array of slots formed in the grater surface.

8. The bar soap grating apparatus of claim 1, wherein the grater surface comprises an array of teeth extending upward from an array of slots formed in the grater surface as an array of protruding teeth each with a cutting edge.

9. A grating device for generating soap flakes, comprising:

a grater body having a bar soap chamber positioned over a soap flake dispensing chamber and containing bar soap;

a grater plate in contact with the bar soap and comprised of a grater surface with a bar soap inserted into the bar soap chamber and vertically positioned so that a surface of the bar soap firmly contacts the grater surface using an attached stabilizing tension flat spring in an inner adjacent wall of the bar soap chamber in contact with the bar soap placed into the bar soap chamber to stabilize vertical and lateral contact with the grater plate;

at least one stop integrated with the grater plate to moveably secure the grater plate inside the grater body by engaging a rear surface of the grater body at a vertical top of the soap flake dispensing chamber, said grater plate moveably structurally integrated with the soap flake dispensing chamber;

wherein the grater plate when pushed in and out of the grater body moves the grater surface back and forth across the bar soap to shave flakes off the bar soap to fall into the soap flake dispensing chamber.

10. The grating device for generating soap flakes of claim 9, wherein the soap flake dispensing chamber comprises an open lower portion of the grater body formed by support legs and sized to receive a human hand.

11. The grating device for generating soap flakes of claim 9, further comprising a soap weight positioned to exert force on the bar soap to contact the grater surface.

12. The grating device for generating soap flakes of claim 9, wherein the grater body comprises a lower section forming the soap dispensing chamber.

13. The grating device for generating soap flakes of claim 12, wherein the base comprises an adhesive to attach to a surface.

14. The grating device for generating soap flakes of claim 9, wherein the grater surface comprises at least one angled blade.

15. The grating device for generating soap flakes of claim 9, wherein the grater surface comprises a plurality of cutting edges integrated with an array of slots.

16. The grating device for generating soap flakes of claim 9, wherein the grater surface comprises an array of teeth or cutting edges extending upward from an array of slots.

17. A method for generating flakes from a bar of soap, comprising the steps of:

positioning a bar soap in a bar soap chamber over a soap flake dispensing chamber comprising a grater body;

interposing a grater between the bar soap chamber and the soap flake dispensing chamber at a vertical top of the soap flake dispensing chamber moveably retained inside the grater body by at least one attached stop engaging a rear surface at the vertical top of said soap flake dispensing chamber;

extending the grater outward from the grater body using an integrated handle with the soap bar placed into the bar soap chamber to make contact with the grater, said handle further comprising an elongated roughly U-shaped structure integrated with the soap flake dispensing chamber configured into two elongated parallel sides attached to a flat grater surface to form the grater, with at least one of the two parallel sides terminating in the at least one attached stop that engages the rear surface of the vertical top of the soap flake dispensing chamber forming the stop, with the U of the structure forming a grip for the handle;

using a stabilizing tension flat spring attached to a vertical inner side of said bar soap chamber adjacent to and in contact with the bar soap placed into the bar soap chamber to stabilize vertical and lateral contact with the grater;

wherein the grater when pushed in and out of the grater body using the handle moves the grater back and forth across a surface of the bar soap to shave soap flakes off the bar soap that fall into the soap flake dispensing chamber and said grater comprises an array of cutting teeth extending upward from the greater and an array of slots through which the soap flakes fall.

18. The method for generating flakes from a bar of soap of claim 17, wherein the soap flake dispensing chamber comprises a base in a lower portion of the grater body sized to receive a human hand.

19. The method for generating flakes from a bar of soap of claim 17, further comprising— placing a soap weight over the bar soap to force the bar soap down upon the grater.

20. The method for generating flakes from a bar soap of claim 17, wherein the grater surface includes an array comprising multiple cutting elements of at least one angled blade, one cutting edge, and/or one tooth and slots.

21. A bar soap grating apparatus, comprising:

a grater body having a bar soap chamber positioned over a soap flake dispensing chamber, said bar soap chamber including at least one vertical side having an attached stabilizing tension flat spring adjacent to and in contact with a bar of soap placed into the bar soap chamber to stabilize vertical and lateral contact with the grater plate;

the grater plate interposed between the bar soap chamber and the soap flake dispensing chamber comprising a handle at an one end extending outward from the grater body and a stop positioned at a second end with a grater surface between the first end and the second end, and configured so a bar of soap placed into the bar soap chamber is positioned in contact against the grater surface and configured so said stop engages a rear surface at a vertical top of the soap flake dispensing chamber when the handle moves outward from the grater body;

said handle further comprising an elongated roughly U-shaped structure configured into two parallel sides attached to a flat grater surface to form the grater plate and a top of the soap dispensing chamber, with the two parallel sides terminating in the two stops that engage the rear surface at the vertical top of the soap flake dispensing chamber forming the stop, with the U of the structure forming a grip for the handle; and wherein the handle when pushed in and out of the grater body moves the grater plate back and forth across a bottom surface of the bar of soap to shave flakes off the bar of soap that fall into the soap flake dispensing chamber.

22. The bar soap grating apparatus of claim 21, further comprising the stabilizing tension flat spring placed adjacent to the bar of soap and attached to an inner surface of the least one vertical side to stabilize both vertical and lateral contact of the bar of soap with the grater plate.

* * * * *